US005299112A

United States Patent [19]

Nivette, Jr. et al.

[11] Patent Number: 5,299,112

[45] Date of Patent: Mar. 29, 1994

[54] SUPPORT BAR FOR ADJUSTABLY MOUNTED ACCESSORIES

[75] Inventors: Roland C. Nivette, Jr., Lancaster; Steven B. Jackson, Carson; Christopher L. Tueber, Venice, all of Calif.

[73] Assignee: Alnic Industries, Sun Valley, Calif.

[21] Appl. No.: 941,740

[22] Filed: Sep. 8, 1992

[51] Int. Cl.[5] ..... F21S 1/10

[52] U.S. Cl. ..... 362/431; 362/250; 362/426; 211/206; 248/323

[58] Field of Search ..... 362/250, 396, 426, 431; 248/323; 211/182, 206

[56] References Cited

U.S. PATENT DOCUMENTS

| | | | |
|---|---|---|---|
| 4,037,098 | 7/1977 | Kowalkski | 348/323 X |
| 4,414,617 | 11/1983 | Galindo | 362/250 |
| 4,471,415 | 9/1984 | Larson et al. | 362/396 |
| 4,591,957 | 5/1986 | Harwood | 362/249 X |
| 4,837,665 | 6/1989 | Hoyer et al. | 362/250 |

FOREIGN PATENT DOCUMENTS

| | | | |
|---|---|---|---|
| 0067280 | 6/1978 | Japan | 248/323 |

*Primary Examiner*—Richard A. Bertsch
*Assistant Examiner*—Michael I. Kocharov
*Attorney, Agent, or Firm*—Harlan P. Huebner

[57] ABSTRACT

A support bar for adjustably mounting accessories such a theatrical lamps wherein the bar is preferably formed of extruded aluminum and the bar is hollow with a closed interior electrical raceway for electrical cables extending the length of the bar and is isolated from a quadrilateral opening extending the length of the bar that communicates with the quadrilateral opening and the exterior of the bar. Adjustable mounting means extend from the lamps into the quadrilateral opening to mount the accessory and to allow sliding movement thereof within the bar.

7 Claims, 1 Drawing Sheet

SUPPORT BAR FOR ADJUSTABLY MOUNTED ACCESSORIES

BACKGROUND OF THE INVENTION

1. Field of the Invention

This invention relates to a support bar for adjustably mounted accessories and particularly to an extruded support bar for electric lights such as theatrical lamps and adapted to receive electric wiring therein. Also the support bar may serve as a conduit for wires such as fiber optic wiring without departing from the spirit of the invention.

2. Description of the Prior Art

Prior to the present invention theatrical lights for motion picture sound stages and theatrical stages consisted of an elongated hollow tube that was preferably horizontally mounted with a series of holes bored diametrically through the tube. When it was desired to mount a theatrical light or lamp that included a mounting bracket a bolt passed through the diametric bores and a nut held the lamp in place.

The wires running to the lamp passed within the tube and exited a bore near the mounting holes.

The disadvantage of this arrangement has been that there was no true adjustability of the lamp on the bar. If the lamp has to be moved the bolt and nut must be removed and inserted in another of a series of mounting holes.

In other words the positioning of the lamps along the bar were at the control of the locations of the mounting holes. If there were no mounting holes at the location on the bar where the lamp should be mounted the exact desired position could not be achieved.

Further, with the light bar being drilled with a series of diametric mounting holes the structural integrity of the bar was weakened. With a series of lamps suspended from the bar and such weakness occurs the bar could break.

Also with the prior art lighting bars the electrical wires passing through the bar and not being separated or in separate cable compartments or electrical raceways just add to the chances of shorting and other electrical problems.

In addition, in camera mounting bars for vehicles in the motion picture business again diametric holes are provided, but true adjustability of the cameras or lamps on the exterior of the vehicle for interior vehicle shots is limited.

Further, with prior art camera mounting bars the bar can also achieve structural weaknesses causing collapse of the same. This is particularly true with the weight of conventional motion picture cameras.

SUMMARY OF THE INVENTION

It is a purpose of the present invention to provide a support bar for mounting accessories wherein the accessory may be adjustably positioned along said bar at any desired location.

Another object of the present invention is to provide a support bar that is extruded and preferably made of aluminum for light weight.

A still further object of the present invention is to provide a support bar that is adapted to be used for adjustably mounting theatrical lamps therealong.

A yet further object of the present invention is to provide a support bar for use in mounting lamps wherein the interior of the bar is formed with a separated electrical cable raceway.

A further object of the present invention is to provide a support bar that includes a generally U shaped locking channel that extends the length of said bar and is separated from an electrical raceway. The channel communicates through the wall of the bar and a locking nut is slidably mounted within said channel to receive a bolt holding an accessory for precise mounting along said bar. Another advantage of the present invention is to provide a support bar as a conduit for wiring that is compartimentized.

These and other objects and advantages will become apparent from the following part of the specification wherein details have been described for the competence of disclosure, without intending to limit the scope of the invention which is set forth in the appended claims.

BRIEF DESCRIPTION OF THE DRAWINGS

These advantages may be more clearly understood from the following detailed description and by reference to the drawings in which.

DETAILED DESCRIPTION OF THE PREFERRED EMBODIMENT

Figure 1:
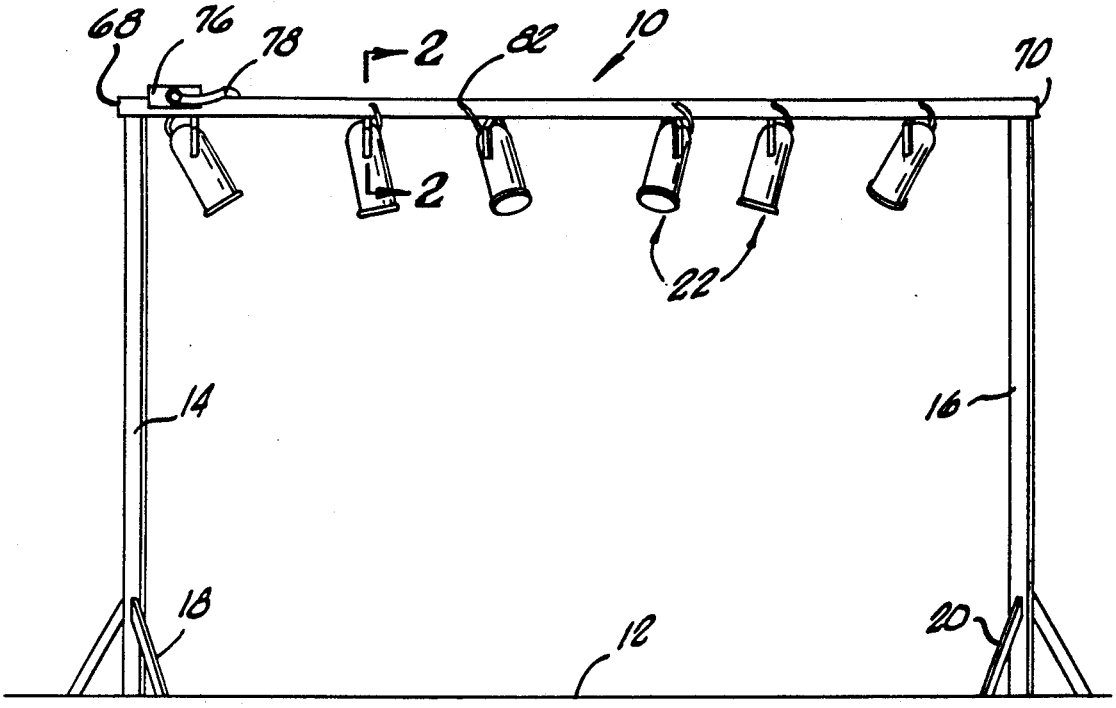
FIG. 1 is an environmental view of the invention mounted as a support bar for adjustably mounting theatrical lamps therealong.

In FIG. 1 there is illustrated a support bar generally designated 10. In the illustrated embodiment the bar 10 is shown being utilized on a stage having a floor 12. The stage could be legitimate on motion picture.

The illustration in FIG. 1 shows the support bar mounted horizontally above the floor 12. The bar 10 is being supported above the stage floor 12 by a pair or vertical end supports 14 and 16 that has brace elements 18 and 20 secured to floor 12.

In other stage uses the bar 10 may be suspended from ceiling supports (not shown). In addition the support bar 10 could also be arranged vertically.

With the illustrated support bar 10 a plurality of conventional theatrical lamps or lights designated 22 are adjustably positioned along the bar 10.

While the support bar 10 is shown for use on a stage other uses are also available. The bar 10 would be particularly useful in the entertainment industry as the support bar for an exterior car mount wherein a camera and/or lights may be adjustably mounted thereon and power may be supplied through the interior of the bar 10. In addition, the bar could be used for ceiling suspension in stores and shops. Further the support bar 10 when used as a wire conduit could be mounted on a wall, floor or ceiling.

Figure 2:
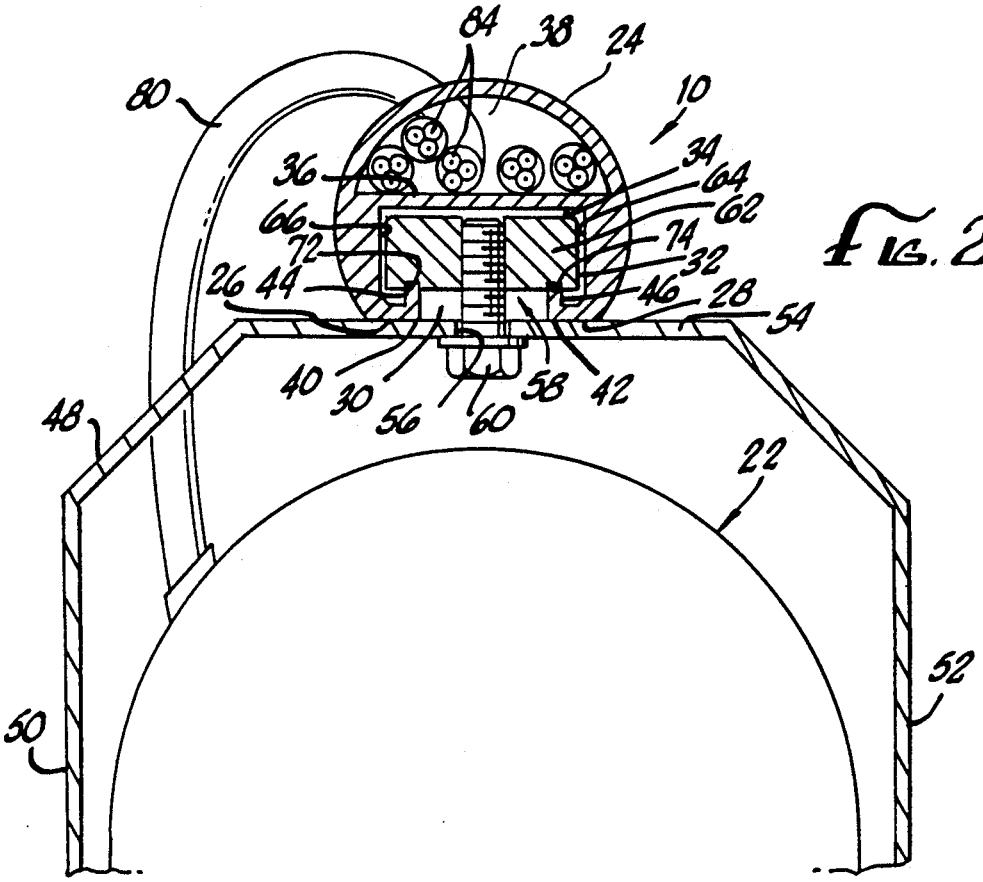
FIG. 2 is a cross sectional view of the invention taken on line 2—2 of FIG. 1.

Turning to FIG. 2 there is illustrated the cross section of the support bar 10. In practice the bar 10 is preferably made of extruded aluminum for strength and weight. The extrusions may be any length and cut to the desired end use length.

As can be seen the support bar 10 is circular with an annular interior wall 24 and at the bottom the bar 10 is cut off across a chord forming bottom exterior generally flat support walls 26 and 28. The walls 26 and 28 form an entrance channel opening 30 that passes into a channel 32 that is preferably quadrilateral in cross-section formed along the length of the bar 10.

The upper surface 34 of the channel 32 is formed by a wall 36 that extends across the bar 10 from one side of wall 24 to the other. The wall could be diametrically positioned or as illustrated chordially positioned.

Between the arcuate or circle wall 24 and the wall 36 a power line chamber or electrical raceway 38 is formed along the length of the support bar 10 during extrusion. With the raceway 38 electrical cables, to be described, may pass along the length of the raceway and the isolation of the cables from the attachment of lamps 22 will insure against any electrical problems.

In order to complete the cross sectional arrangement of the bar 10 ends 40 and 42 are turned inwardly forming runners 44 and 46 that extend into cross-sectional quadrilateral opening 32. Thus between the runners 44 and 46 the entrance channel opening 30 extends into the opening 32 and formed on a chord of the circular wall 24.

Each of the lamps 22 include a conventional U shaped mounting bracket designated 48 that includes a pair of side bars 50 and 52 which include pivot means at their ends mounted to the lamps 22 (not shown) for adjustment of the lamps. The bracket 48 also includes a web portion 54 that extends between the side bars 50 and 52.

Within the web 42 there is provided a mounting hole 56 to affix the bracket 40 to the support bar 10.

There are adjustable mounting means 58 provided. The mounting means includes a bolt 60 that passes through the openings 56 and 30 into a channel nut 62. The channel nut 62 conforms to the cross-sectional quadrilateral opening 32 and is slightly less in width than the distance between side wall 64 and 66. The reason for the dimension is that when the bolt 60 is inserted through the end 68 or 70 of the extruded bar 10 it will be prevented from rotating when in the opening 32.

In addition the channel nut 62 may be fitted with parallel grooves 72 and 74 adapted to ride on runners 44 and 46.

The bolt 60 passes into the channel nut 62 and when tightened the lamp 22 is affixed to the bar 22. It can also been seen that with the sliding of the nut along the runners 44 and 46 a lamp 22 may be positioned with much greater precision than previously available. Also as the bolt 60 is tighten the bracket 48 is cinched up against the flat surfaces 26 and 28 of the bar 10 to lock the lamp 22 in place.

In the preferred embodiment of the invention at one end 68 or 70 of the support bar 10 an electrical junction box 76 (FIG. 1) may be provided. The box 76 may have electric current through an electrical feed line 78 into the box where it can be journaled to individual lines and then to a male portion of a conventional multiplex connector (not shown) that may also be secured on the outside of the support bar 10. Usually there are multiples connectors for each lamps 22 to be placed on the bar 10.

The female portion (not shown) of the connector will usually be affixed to the end of an electrical cable 80 that will pass into the raceway 38 through openings 82 (not seen) that are cut into the bar 10 and communicates with the raceway 38.

Electrical cables 84 will pass through the raceway from the connectors that may be affixed to the bar 10 to the junction box 76.

While a multiplex connector is preferred for ease of removing a theatrical lamp 22 for repair or replacement any known method of electrically connecting a lamp with the power source at the junction box 76 may be used without departing from the spirit of the invention.

As can be seen with a lamp 22 mounted in the support bar 10 by mounting means 58 the lamp 22 may be moved along the bar for mounting at any desired position. The adjustability is only curtailed by the length of the cable 80.

Previously with light bars a series of holes were drilled and each time it was desired to shift the lamp, it had to be disconnected from the bar and re-inserted into a new hole. With the present invention all that is necessary is to loosen bolt 60 and slide the bracket 48 and mounting means 58 to the desired location.

Such arrangement of the present invention make the re adjustment of lamps extremely easy and fast. Finally, while the preferred embodiment of the support bar 10 is for stage use, the bar 10 may be used as a conduit for any type of wiring in raceway 38. The bolt 60 could pass into a wall (not shown) to hold the bar in place against wall so that the accurate wall 24 faces outward.

The invention and its attendant advantages will be understood from the foregoing description and it will be apparent that various changes may be in the form, construction and arrangement of the parts without departing from the spirit and scope thereof or sacrificing its material advantages, the arrangements herein before described being merely by way of example. We do not wish to be restricted in the accompanying claims, wherein various portions have been separated for clarity of reading and not for emphasis.

We claim:

1. A support bar for receiving adjustably mounted electrical accessories wherein said bar is fixedly mounted relative to a structure and said accessories each include couplable means that can maintain said accessories to said bar, said bar comprising;

an elongated tubular support bar having a common cross section throughout its length, the interior of said support bar divided into an electrical raceway and channel that passes longitudinally through said tubular support bar, said raceway and said channel having a common wall that extends across said support bar wherein said raceway is isolated from said channel and said channel is quadrilateral in cross section, and an entrance opening extends through a portion of said support bar communicating with said channel; and slidable mounting means to receive said electrical accessories including a non-rotatable channel nut slidably inserted within said channel and a bolt passing through said entrance opening into said channel nut and said mounting means may be locked to said bar to prevent movement thereof.

2. A support bar as defined in claim 1, wherein said extruded support bar is aluminum.

3. A support bar as defined in claim 1 wherein:

said accessories are theatrical lamps that include electrical cable passing from said lamps within said raceway; and an electrical junction box on said support bar, said box adapted to receive electricity from a source and cabling means to dispute electricity to said electrical accessories.

4. A support bar as defined in claim 1, wherein:

said supporting bar is mounted parallel to a floor and above said floor.

5. A support bar for receiving adjustably mounted electrical accessories wherein said bar is fixedly mounted relative to a structure and said accessories each include couplable means that can maintain said accessories to said bar, said bar comprising:

an elongated extruded tubular support bar having a common cross section throughout its length, the interior of said support bar divided into an electrical raceway and an elongated mounting opening that is a quadrilateral in cross section, and a common elongated wall separating said raceway and said mounting opening, and an entrance opening extends through a portion of said support bar, communicating with said elongated mounting opening; and slidable mounting means within said elongated mounting opening including a channel nut slidably inserted therein and of a cross sectional width slightly less than the cross sectional width of said elongated mounting opening and a bolt passing into said nut wherein rotation of said nut is prevented and said couplable means may be locked to said bar to prevent movement thereof and adapted to receive said accessory means therein and slidably move within said opening to releasably fixedly secure said electrical accessory where desired on said support bar.

6. A support bar as defined in claim 5 wherein:

said extruded support bar is aluminum.

7. A support bar for receiving wiring, said bar adapted for flush mounting to a flat surface comprising;

an elongated endless frusto circular tubular member in cross section having a common cross section throughout its length, the interior being divided by a common wall extending across said circular tubular member forming a raceway on one side of said wall and an elongated mounting opening on the opposite side, an entrance opening extending through said tubular member communicating with said elongated mounting opening and being defined by a pair of opposed generally flat walls formed on a chord of said circular member; and slidable mounting means lockable within said elongated mounting said flat adapted to interface with surface for securement to said flat surface of said support bar wherein said circular tubular member extends outward from said surface.

* * * * *